United States Patent [19]

Morck

[11] 4,416,620

[45] Nov. 22, 1983

[54] LARGER CAPACITY VORTEX BURNER

[75] Inventor: Charles W. Morck, Philadelphia, Pa.

[73] Assignee: Selas Corporation of America, Dresher, Pa.

[21] Appl. No.: 271,494

[22] Filed: Jun. 8, 1981

[51] Int. Cl.[3] ..... F23D 13/12

[52] U.S. Cl. ..... 431/348; 431/181; 431/187; 239/403; 239/419.3; 239/424

[58] Field of Search ..... 431/348, 347, 284, 187, 431/181, 182; 239/400, 403, 404, 419.3, 424

[56] References Cited

U.S. PATENT DOCUMENTS

| | | | |
|---|---|---|---|
| 1,754,603 | 4/1930 | Brown | 431/348 |
| 2,339,477 | 1/1944 | Hess et al. | 431/348 |
| 2,561,793 | 7/1951 | Furczyk | 431/348 |
| 2,561,795 | 7/1951 | Hess et al. | 431/348 |
| 2,762,428 | 9/1956 | Blaha | 431/348 |
| 2,904,108 | 9/1959 | Blaha | 431/348 |
| 3,083,759 | 4/1963 | Williams | 431/348 |
| 3,692,460 | 9/1972 | Morck | 431/348 |
| 3,940,234 | 2/1976 | Reed et al. | 431/348 |
| 4,220,444 | 9/1980 | Reed et al. | 431/348 |
| 4,239,481 | 12/1980 | Morck | 431/348 |
| 4,257,762 | 3/1981 | Zink et al. | 431/348 |

FOREIGN PATENT DOCUMENTS

| | | | |
|---|---|---|---|
| 40-16715 | 7/1965 | Japan | 431/348 |
| 825127 | 12/1959 | United Kingdom | 431/348 |

*Primary Examiner*—Samuel Scott
*Assistant Examiner*—Margaret A. Focarino
*Attorney, Agent, or Firm*—Austin R. Miller

[57] ABSTRACT

A Vortex burner is provided in a burner block having a conduit spaced within the burner block passageway to provide an annular space between them. Fuel gas flows through the central portion of the burner, and is tangentially discharged through gas nozzles. Primary air is induced through the portion of the burner surrounding the fuel gas inlet means. Secondary air is induced into the burner through the portion of the burner surrounding the primary inlet means via draft. A deflector member disposed at a suitable angle to the primary air conduit and protruding from the discharge end of said conduit, directs the secondary air along the cup surface and causes it to mix with the partial premixture of primary air and gas. The deflector member aerodynamically directs the primary air and gas premixture along the cup surface. The secondary air flow prevents annular recirculation of hot gases. The design is utilized to maintain and improve mixing, to move the burner tip forward as far as possible into the furnace and to avoid annular recirculation of hot gases. A shallow rippled cup is also used to promote wall wiping.

11 Claims, 2 Drawing Figures

LARGER CAPACITY VORTEX BURNER

BACKGROUND OF THE INVENTION

1. Field of the Invention

The present invention relates to a Vortex burner, and more particularly to a large capacity petrochemical gas furnace burner.

2. Description of the Prior Art

Vortex burners are utilized in industrial type furnaces. A Vortex burner is typically a nozzle-mix burner which utilizes the tangential energy of the fuel gas, assisted by furnace draft, to entrain combustion air, mix the combustion air with the gas, and inject the burning mixture onto a radiant cup portion of the burner and along the furnace wall.

Several Vortex burner designs are known in the prior art. Although the prior art generally discloses means for mixing gas, primary air and secondary air at the nozzle tip location, the prior art certainly does not suggest the novel combination of the present invention.

U.S. Pat. No. to Furczyk 2,561,793 is an earlier forced air nozzle mix burner developed for the Steel Industry. This arrangement disclosed by Furczyk clearly produces a different mixing effect than is achieved in the present invention.

The tangential feature in U.S. Pat. No. to Hess et al, 2,561,795 is used solely for the efficient atomization of liquid fuel and hence, pertains to a different field of art than the present gaseous fuel burner invention.

U.S. Pat. Nos. to Hess 2,339,477 and to Blaha 2,762,428 disclose a rippled cup surface to enhance flame stability and radiant heat transfer. However, except for that particular feature, these patents fail to suggest any of the other novel elements claimed in the present invention.

U.S. Pat. No. to Brown 1,754,603 discloses a central tube surrounded by an annular space, wherein secondary air is transported through the central tube while gas and primary air are transported through the outwardly disposed annular space. This design is opposite to the present invention. Although Brown does disclose a secondary air flow deflector, this arrangement does not perform the novel dual functions of the deflector in the present invention.

U.S. Pat. No. to Morck 3,692,460 teaches the use of a centrally disposed fuel gas supply tube around which combustion air flows in an annular space. Furthermore, this patent teaches the use of tangentially discharged gas jets in order to entrain the combustion air, mix it with the fuel gas and direct the mixture onto the cup and along the furnace wall.

OBJECTS OF THE PRESENT INVENTION

There have been serious overheating problems in some of the conventional petrochemical Vortex burners. In these conventional burners, hot gas circulation patterns along the furnace walls cause serious casing overheating problems. It is an object of the present invention therefore to overcome such overheating problems.

The conventional Vortex burner typically has two #30 gas nozzles sized to obtain 1.25 MM BTU/Hr. rated capacity at 20 PSIG gas pressure and 0.2 "W.C. draft on natural gas. Typically, such a conventional Vortex burner will have a diameter of approximately 6⅛ inches.

In many gas furnace applications, a larger capacity Vortex burner is required. These larger capacity burners may have diameters of up to 9 inches and capacities up to 3.3 MM BTU/Hr. However, until the present, attempts to "scaleup" existing Vortex burners have resulted in poorer gas-air mixing and casing overheating problems caused by the burner tip having to be recessed further into the bore of the cup to allow sufficient time for adequate mixing.

Thus, it is an object of the present invention to utilize a burner to which the tip is positioned as far as possible into the furnace while still providing adequate mixing.

The present invention maintains and improves mixing efficiency in these larger capacity Vortex burners, while allowing the tip to be positioned as far as possible into the furnace in order to avoid the annular recirculation of hot gases causing casing overheating problems. Furthermore, the present invention utilizes a shallow cup to promote wall wiping.

SUMMARY OF THE INVENTION

A large capacity Vortex burner includes a burner block having a cup-shaped recess at one surface of the block and a passageway or bore extending from the base of the cup-shaped recess to the opposite surface of the block. The bore is capable of carrying a secondary air supply. An air sleeve is disposed within the bore. The air sleeve is capable of carrying a primary air supply. A gas supply pipe is disposed within the air sleeve. The gas supply pipe is capable of carrying the fuel gas. A set of gas nozzles extends from the discharge end of the gas supply pipe, such that their terminal jets are at least in proximity to the inner surface of the discharge end of the air sleeve and rest on the front face of a metal annular shoulder, or fence as it is referred to in the art, near the forward end of said air sleeve. A secondary air flow deflector is also provided.

DESCRIPTION OF THE PREFERRED EMBODIMENTS

Figure 1:
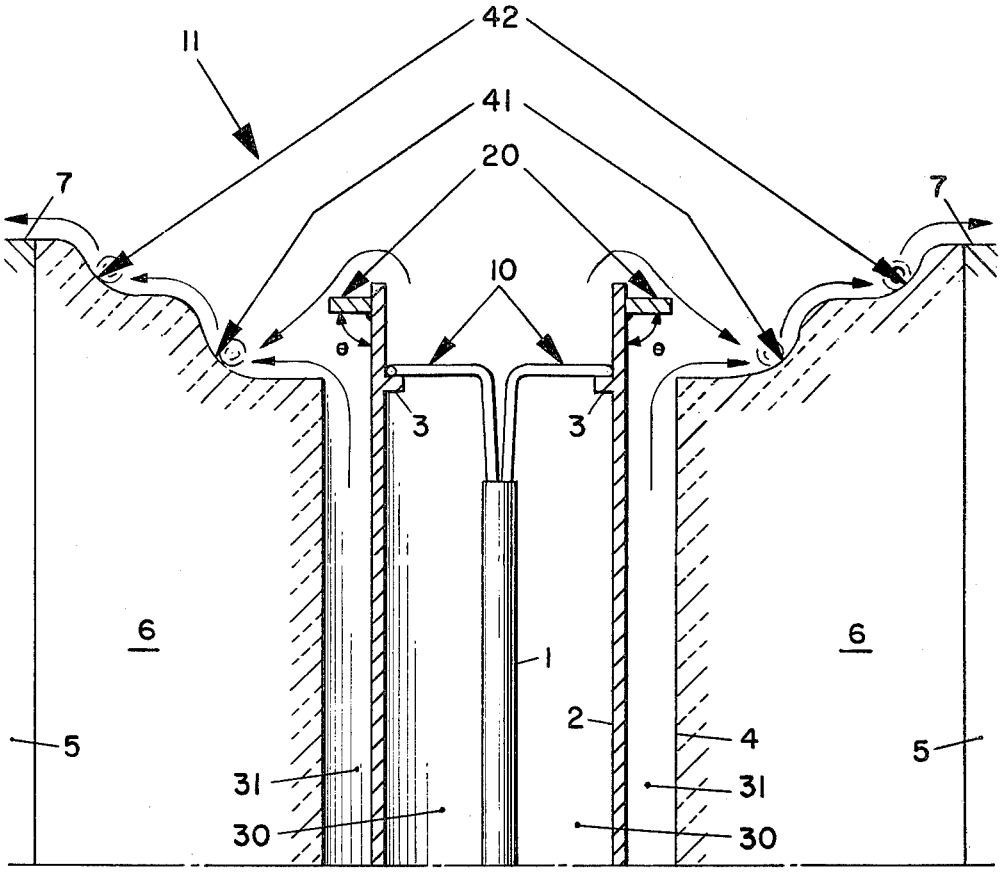
FIG. 1 is a cross-sectional view of a Vortex burner of the present invention.

Referring to the drawings, the Vortex burner of the present invention is designated at 11. Furthermore, with respect to the Vortex burner 11 and/or any individual part thereof, the side or end closest to the furnace interior shall be designated forward and the side or end farthest from the furnace interior shall be designated rearward.

Referring to FIG. 1, the Vortex burner 11 has a burner block 6 with a bore 4. Burner block 6 is disposed within the furnace wall 5. Both are typically composed of a refractory type material. The burner block 6 includes at the surface facing the interior of the furnace a shallow concave cup-shaped recess. The cup surface has two ripples 41 and 42 between the base of the cup and furnace wall surface 7.

Near the rearward end of the bore 4 is a first gas inlet means (not shown). Typically, the first gas inlet means is a conventional air shutter or valve for regulating the secondary air supply flowing through the bore 4. Such a first gas inlet means is known in the art and forms no part of the present invention.

Centrally disposed within the bore 4 is an air sleeve 2. The air sleeve 2 is typically composed of metal and is supported within the bore 4 by conventional supporting means (not shown). The forward end of the air sleeve 7 extends from the base of the cup into the furnace interior a distance less than the depth of the cup. Thus, the forward end of the air sleeve 2 is intermediate the cup base and the furnace wall interior surface 7, as shown in FIG. 1.

At the rearward end of the air sleeve 2 is a second gas inlet means (not shown). Typically the second gas inlet means is a conventional air shutter or valve for regulating a primary air supply flowing through air sleeve 2. Both the second gas inlet means and the supporting means for the gas supply pipe 1 are known in the art and form no part of the present invention. Near the forward end of the air sleeve 2 is connected a deflector plate 20 further to be described in detail hereinafter.

Centrally disposed within the air sleeve 2 is the gas supply pipe 1, also typically composed of metal and supported within the air sleeve 2 by conventional supporting means (not shown). At the rearward end of the gas supply pipe 1 is a third gas inlet means (not shown) which is typically a conventional valve. The third gas inlet means controls a fuel gas flowing through the gas supply pipe 1. Again, this gas inlet means is known in the art and forms no part of the present invention.

The secondary air supply flows only through that portion of the bore 4 not occupied by the air sleeve 2, i.e., the annular space 31, Similarly, the primary air supply flows only through that portion of the air sleeve 2 not occupied by the gas supply pipe 1, i.e., the annular space 30. The fuel gas flows through the gas supply pipe 1 and gas nozzles 10.

A set of gas nozzles 10 extends from the forward end of the gas supply pipe 1, in fluid sealing relation thereto, such that the terminal orifices of the gas nozzles 10 are at least in proximity to the interior surface of the air sleeve 2 near its forward end and proximate to the plane containing the cup base. More specifically, the terminal orifices of gas nozzles 10 are tangentially positioned about the interior surfaces of the air sleeve 2 and rest on the forward side of a metal annular fence 3 near the forward end of air sleeve 2. The fence 3 is provided to prevent pumping back of the fuel gas.

Figure 2:
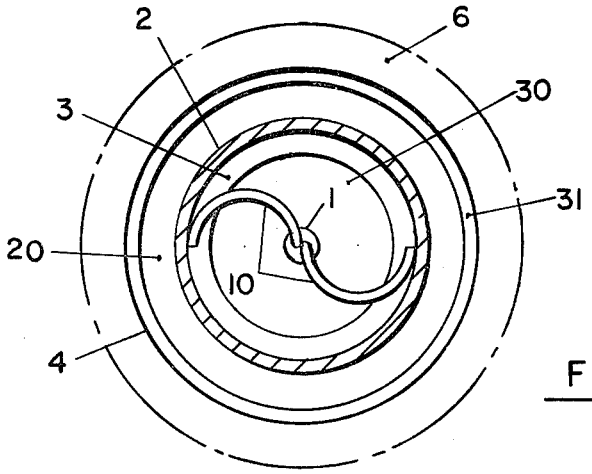
FIG. 2 is an end view of the Vortex burner of FIG. 1 looking from the furnace interior.

Referring to FIG. 2, the configuration of gas nozzles 10 and their tangential positions are shown. The forward end of gas supply pipe 1 has two gas nozzles 10 connected to fluid communication therewith. Gas nozzles 10 consist of curved tubular arms having forward ends terminating adjacent to the inner surface of air sleeve 2 and adjacent to the forward side of the annular fence 3, with the discharge orifices of the gas nozzles pointing in a tangential direction substantially perpendicular to the burner axis. Fuel gas is discharged into the burner through gas supply pipe 1 and then through the arms of the gas nozzles 10. For this purpose the orifices at the forward ends of gas nozzles 10 are formed as jets or, if desired, they can be provided with small replaceable orifices similar to the type used in inspirator burners.

In the operation of the Vortex burner of the present invention a fuel such as natural gas typically flows through the gas supply pipe 1 and through the gas nozzles 10. The gas nozzles 10 impart a whirling flow pattern to the gaseous fuel as it exits from the gas nozzle orifices. The fuel gas exiting from the gas nozzles 10 entrains primary combustion air flowing through the annular space 30 and mixes with it to form a partial premixture of fuel gas and primary combustion air. This partial premix of fuel gas and primary combustion air whirls toward the forward end of air sleeve 2. Upon exiting the air sleeve 2, the fuel gas and primary combustion air premix is drawn toward the first ripple 41 by the centrifugal force of the Vortex flow pattern and a small vacuum pocket existing at the step between the forward end of air sleeve 2 and the forward side of deflector plate 20. The slight vacuum is caused by the flow of said partial premix of fuel gas and primary combustion air past the forward end of air sleeve 2. Secondary air is also directed from annular space 31 by deflector plate 20 toward the first ripple 41. The partial premix of fuel gas and primary air and the secondary air are both drawn into first ripple 41 where mixing of the two streams occurs. In addition to this mixing function, ripple 41 anchors the flame and directs the gas mixture along the cup surface into the second ripple 42. The second ripple 42 anchors the flame to the cup surface and promotes cup wiping and wall wiping. The gas mixture is drawn radially outwardly from the burner axis due to partial vacuum pockets existing in the depressions of the ripples 41 and 42.

In working to solve the problems of poor air-gas mixing and casing overheating encountered in previous large capacity Vortex burner designs, I have discovered that the use of both primary and secondary air flows, together with the novel deflector plate 20, achieves more rapid and efficient mixing in very large capacity Vortex burners. Uniquely, the deflector plate 20 mounted near the forward end of air sleeve 2 acts to both mechanically deflect the secondary air flow exiting from the bore 4 and also aerodynamically deflect, through the action of the centrifugal force of the Vortex and the slight vacuum in front of deflector plate 20, the primary air-gas mixture exiting from the center of the burner. Although the mechanisms for the aerodynamic effect on the primary air-gas mixture is not completely understood, the deflector plate 20 mounted on the end of the air sleeve 2 at an angle $\theta$ of approximately 90°, as shown in FIG. 1, helps to direct the primary air-gas mixture along the rippled surface of the cup and thereby enhances anchoring of the flame along the cup surface. This phenonmenon of anchoring the flame to the cup surface, referred to as flame stabilization, is very desirable since it improves cup wiping and promotes wall wiping. Thus, the flame spreads over a large area of the furnace wall 7 thereby promoting more even heating of objects in the furnace. It has been discovered that the novel combination of the shallow rippled surface, deflector plate 20 and tangentially discharged gas nozzles 10 greatly enhances wall wiping.

It has also been found that the tangentially discharged gas nozzles 10 help direct the primary air-gas mixture along the burner cup surface. Consequently, the present invention is able to achieve superior air-gas mixing efficiency even in Vortex burners with capacities three times greater than normal.

A variation of the embodiment described in the drawings concerns an additional burner tube placed within, and flush against the surface of, bore 4. It should be appreciated by those skilled in the art that such a burner tube falls within the purview of the present invention.

Although this invention has been described with reference to specific forms thereof, certain modifications having been mentioned in the specification, it will be appreciated that a wide variety of other changes may be made without departing from the spirit and scope of the invention. For example, equivalent elements may be substituted for those specifically shown and described, parts may be reversed, and certain features may be used independently of other features, all without departing from the spirit and scope of the invention as defined in the appended claims.

I claim:

1. A vortex burner comprising:

a. a burner block adapted to be inserted in a furnace wall, the block having a cup and a bore extending through the block to the cup base;

b. primary air supply means within the bore having a forward end extending beyond the cup base;

c. fuel gas supply means, having nozzles, within the primary air supply means for mixing fuel gas with primary air and imparting a whirling flow pattern to the primary air and fuel gas mix as it exits from the forward end of the primary air supply means;

d. secondary air supply means surrounding the primary air supply means within the bore;

e. means for deflecting the secondary air flow into a depression in the cup surface; and f. means for deflecting the whirling primary air and fuel gas mix into the depression for mixing with the secondary air and for anchoring the primary air, secondary air and fuel gas mixture to the cup surface.

2. A vortex burner as defined in claim 1, wherein a protuberance on the cup surface outwardly spaced from the depression and a second depression outwardly spaced from the protuberance, are provided to draw the fuel gas, primary air and secondary air mixture radially outwardly from the primary air supply means along the cup surface, enhancing the mixing of the primary air, secondary air and fuel gas and to anchor and deflect along the furnace wall a flame supported by burning the mixture.

3. A vortex burner as defined in claims 1 or 2, wherein backpumping preventing means are provided rearward the nozzles.

4. A Vortex burner comprising:

a. a burner block adapted to be inserted in a furnace wall, said block having a shallow cup-shaped recess facing said furnace interior and having two ripples therein, said block having a bore therethrough and opening into the base of said cup-shaped recess;

b. tubular means annularly spaced within said bore and having a forward end intermediate said base and exit of said cup;

c. annular plate deflector means extending outwardly about said tubular means near the forward end thereof;

d. back pumping preventing means extending inwardly about said tubular means near the forward end thereof;

e. a plurality of gas nozzles for transporting said fuel gas, said nozzles having discharge orifices proximate the interior of said tubular means forward said back pumping preventing means, said nozzle orifices being disposed symmetrically with respect to the axis of said bore to discharge fuel gas tangentially to the interior surface of said tubular means and substantially perpendicular to said axis;

f. means for introducing secondary air into an annular space between said bore and said first tubular means; and g. means for introducing primary air into said tubular means.

5. An industrial burner comprising:

a. a burner block adapted to be inserted in a furnace wall, said block having a shallow cup-shaped recess facing said furnace interior and having two ripples therein, said block having a bore extending from the base of said cup-shaped recess to an opposite face of said block;

b. a first tubular member annularly spaced within said bore with a forward end intermediate said cup base and the cup exit;

c. an annular plate extending radially outwardly about said first tubular member near the forward end thereof;

d. an annular ledge extending radially inwardly about the interior of said tubular member;

e. fuel gas supply means comprising a second tubular member annularly spaced within said first tubular member, said fuel gas supply means including a pair of curved tubes extending from the forward end of said second tubular member and terminating at substantially diametrically opposing points at the interior surface of said first tubular member at its forward end and forward said annular ledge to discharge fuel gas in the same direction tangentially to the interior surface of said first tubular member and substantially perpendicularly to its axis;

f. means for introducing secondary air into a first annular space between said burner block bore and said first tubular member; and g. means for introducing primary air into a second annular space between said first and second tubular members.

6. A Vortex burner as defined in claims 4 or 5, wherein a burner tube extends through said bore in fluid sealing relation thereto, said burner tube having a forward end located substantially at the base of said cup-shaped recess.

7. A Vortex burner as defined in claim 4, wherein said annular plate extends radially outwardly about said tubular means.

8. A Vortex burner as defined in claim 4, wherein said plate extending outwardly about said tubular means is located approximately ¼ inch rearward from the forward end of said tubular means.

9. An industrial burner as defined in claim 5, wherein said annular plate extending radially outwardly about said first tubular member is located approximately ¼ inch rearward from the forward end of said first tubular member.

10. A Vortex burner as defined in claims 4 or 5, wherein said outwardly extending annular plate is located approximately 1 inch forward said cup base.

11. A Vortex burner as defined in claims 4 or 5, wherein said primary air is induced by furnace draft and the whirling fuel gas stream and secondary air are induced by furnace draft.

* * * * *